United States Patent [19]

Morgan et al.

[11] 4,181,991

[45] Jan. 8, 1980

[54] MATTRESS FOUNDATION

[75] Inventors: Charles W. Morgan, Rolling Hills; Dale Robinson, Placentia; Farouk Farag, Union City, all of Calif.

[73] Assignee: United Foam Corporation, Compton, Calif.

[21] Appl. No.: 876,466

[22] Filed: Feb. 9, 1978

[51] Int. Cl.[2] ..... A47C 23/04

[52] U.S. Cl. ..... 5/400; 5/239; 5/186 R

[58] Field of Search ..... 5/186 R, 186 B, 191, 5/260–265, 345, 351, 355, 361 B, 361 R, 236, 244, 246; 428/1

[56] References Cited

U.S. PATENT DOCUMENTS

| | | | |
|---|---|---|---|
| 2,225,858 | 12/1940 | Church | 5/239 |
| 2,638,606 | 5/1953 | Austin | 5/239 |
| 3,866,252 | 2/1975 | Rogers, Jr. | 5/345 R |
| 3,892,402 | 7/1975 | Montour et al. | 5/345 R |
| 3,913,154 | 10/1975 | Sweeney | 5/186 R |
| 3,967,331 | 7/1976 | Glassman | 5/236 R |
| 3,986,213 | 10/1976 | Lynch | 5/367 |
| 3,992,432 | 11/1976 | Cervisi | 5/263 |
| 4,067,076 | 1/1978 | Krier | 5/351 |
| 4,100,631 | 7/1978 | Stone | 5/239 |

*Primary Examiner*—Casmir A. Nunberg

*Attorney, Agent, or Firm*—Blakely, Sokoloff, Taylor & Zafman

[57] ABSTRACT

An improved mattress foundation particularly suited for use with foam mattresses to provide proper support for the mattress and to duplicate the feel of box springs. The mattress foundation utilizes an upper and lower frame assembly separated by a flexible, resilient material, which may be in the form of blocks, strips or slabs of flexible, resilient material, with the upper frame assembly preferably being somewhat flexible so as to be capable of deforming from its normal planar condition when subjected to more concentrated loads. The material separating the upper and lower frame assemblies are selected to have a resilience which will support the weight of one or two persons while distributed over the mattress foundation without substantial deflection, but which will deflect significantly when subjected to an individual's weight in more concentrated form, such as occurs when an individual sits on the edge of a bed or is getting into or out of the bed.

5 Claims, 4 Drawing Figures

MATTRESS FOUNDATION

BACKGROUND OF THE INVENTION

1. Field of the Invention

The present invention relates to the field of bedding products, and more particularly to mattress foundations for the support of mattresses on bed frames and the like.

2. Prior Art

Innerspring mattresses and box springs have been very common mattress and mattress foundation devices for a great number of years, and as a result have tended to establish a standard in characteristics and performance against which other mattresses and mattress foundations are judged. An innerspring mattress provides good support for the body, though having a characteristic of taking a permanent set unless part of the load on the mattress is shared by the mattress foundation, a result achieved through the use of the conventional box spring foundation.

In recent years, however, foam mattresses (e.g. flexible urethane foam mattresses) have been recognized as providing comfortable and desirable support for the human body when lying down, and as not having a tendency of taking a permanent set, thereby allowing the use of such mattress materials on a substantially rigid mattress foundation. This results in foam mattresses and rigid mattress foundations enjoying substantial commercial success.

The prior art combination of foam mattresses and rigid mattress foundations provide a high quality and comfortable sleeping foundation, but have other characteristis which are undesirable, partially because they do not provide some of the characteristics of innerspring mattresses and box springs which have become expected by much of the purchasing public, and partially because their lack of these characteristics, quickly experienced in the sales room by the potential purchaser, is inaccurately suggestive of a poor sleeping platform. In particular, when one sits on the edge of an innerspring mattress - box spring combination, both mattress and box springs have a substantial and generally continuous "give ," suggestive of a soft and comfortable sleeping platform. The foam for a foam mattress, however, has a selected density and/or other properties and/or other characteristics to provide a compliance which will allow the desired deflection of the mattress when subjected to the relatively low pressures of a person lying thereon. When a person sits on the edge of a foam mattress bed having a rigid mattress foundation, the higher pressures resulting from the concentration of the body weight generally result in the nearly complete local compression of the foam mattress, creating a relatively hard bottoming effect in contra-distinction to an innerspring mattress - box spring combination, thus inaccurately suggestive of a poor sleeping foundation. Since consumer sales of this type of product may be very substantially effected by such first impressions of a prospective purchaser, it would be highly desirable to have a mattress foundation for use with foam mattresses characterized by "give " similar to that of a box spring at cost more consistent with the cost of a rigid foundation.

BRIEF SUMMARY OF THE INVENTION

An improved mattress foundation particularly suited for use with foam mattresses to provide proper support for the mattress and to duplicate the feel of box springs.

The mattress foundation utilizes an upper and lower frame assembly separated by a flexible, resilient material, which may be in the form of blocks, strips or slabs of flexible, resilient material, with the upper frame assembly preferably being somewhat flexible so as to be capable of deforming from its normal planar condition when subjected to more concentrated loads. The material separating the upper and lower frame assemblies are selected to have a resilience which will support the weight of one or two persons while distributed over the mattress foundation without substantial deflection, but which will deflect significantly when subjected to an individual's weight in more concentrated form, such as occurs when an individual sits on the edge of a bed or is getting into or out of the bed.

Preferred forms of the mattress foundation utilize upper and lower wood frame assemblies with a plurality of flexible urethane foam blocks cemented between oppositely disposed faces of the frame assemblies to provide a particularly simple, quiet and stable assembly.

DETAILED DESCRIPTION OF THE INVENTION

Figures 1, 2:
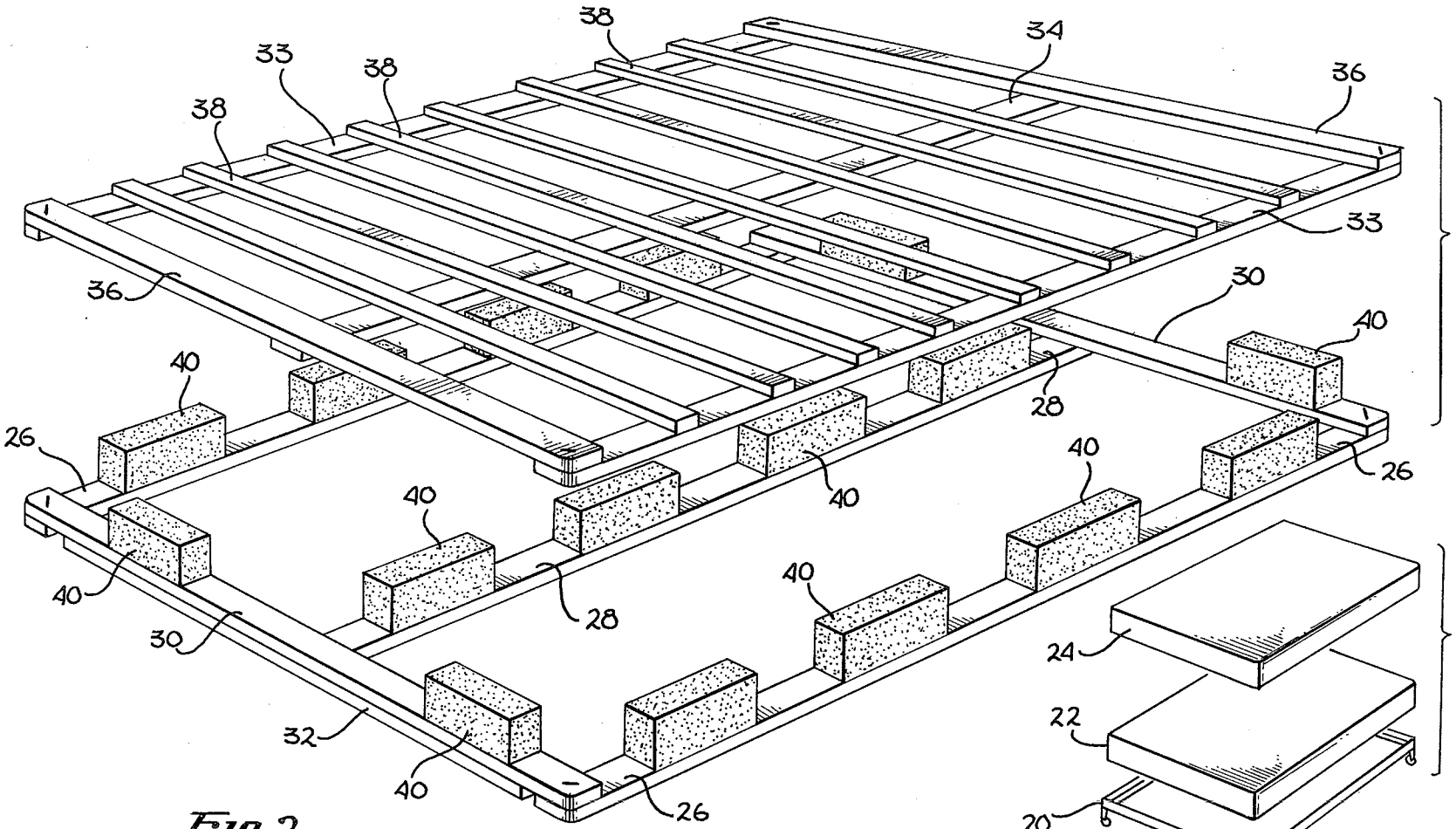
FIG. 1 is an exploded view of a typical bed assembly.
FIG. 2 is a view of a major sub-assembly of a mattress foundation of the present invention.

First referring to FIG. 1, major elements of a typical simple bed may be seen. A bed frame 20 is provided for supporting a mattress foundation 22 on which the mattress 24 is disposed, the bed frame 20 typically ranging from a simple rectangular bed frame supported on legs to ornate and decorative assemblies of various kinds, all generally defining a rectangular supporting surface for the lower outer edges of a mattress foundation, with some form of peripheral edge being provided to confine the foundation with respect thereto.

Now referring to FIG. 2, a perspective view of a major subassembly of a typical mattress foundation in accordance with the present invention may be seen. This assembly is basically comprised of a lower frame structure, an upper, preferably somewhat flexible frame structure, and a plurality of resilient blocks cemented or otherwise attached to oppositely disposed regions of the upper and lower frame structures to provide resilience therebetween. In the preferred embodiment the frame structures are wood frame structures, with the blocks separating the two frame structures being a flexible urethane foam product.

The lower frame structure is comprised of a two side longitudinal members 26 and a central longitudinal member 28. These members, as with the other members making up the upper and lower frame structures, are preferably wood for cost and flexibility reasons, with members 26 and 28 being on the order of one inch thick by three inches wide. Lapped over the ends of members 26 and 28 are cross members 30, also approximately one inch by three inches, with the ends of members 26 and 28 being coupled to the cross bars 30 by heavy staples (or other suitable joining means well known in the mattress foundation frame construction art). In the preferred embodiment, the central longitudinal member 28 is slightly shorter than the longitudinal members 26, with separate end strips 32 being fastened to the surface of the cross members 30, providing a flat, peripheral surface on the bottom of the lower frame assembly to provide a substantially continuous planar peripheral support surface for resting on a bed frame and for the fastening of a foundation ticking thereto.

The upper frame assembly is of similar construction to the lower frame assembly, being comprised of upper side longitudinal members 32 and a center longitudinal 34, with end members 36 overlying and being joined to the ends of the longitudinals. In addition, a plurality of slats 38, generally parallel to the end members 36 and distributed along the length of the longitudinals are provided, with the slats being on the order of an inch thick by one and one-half inches wide, and being joined to the three longitudinals to provide an open platform for support of the materials thereover, as subsequently described.

Figure 3:
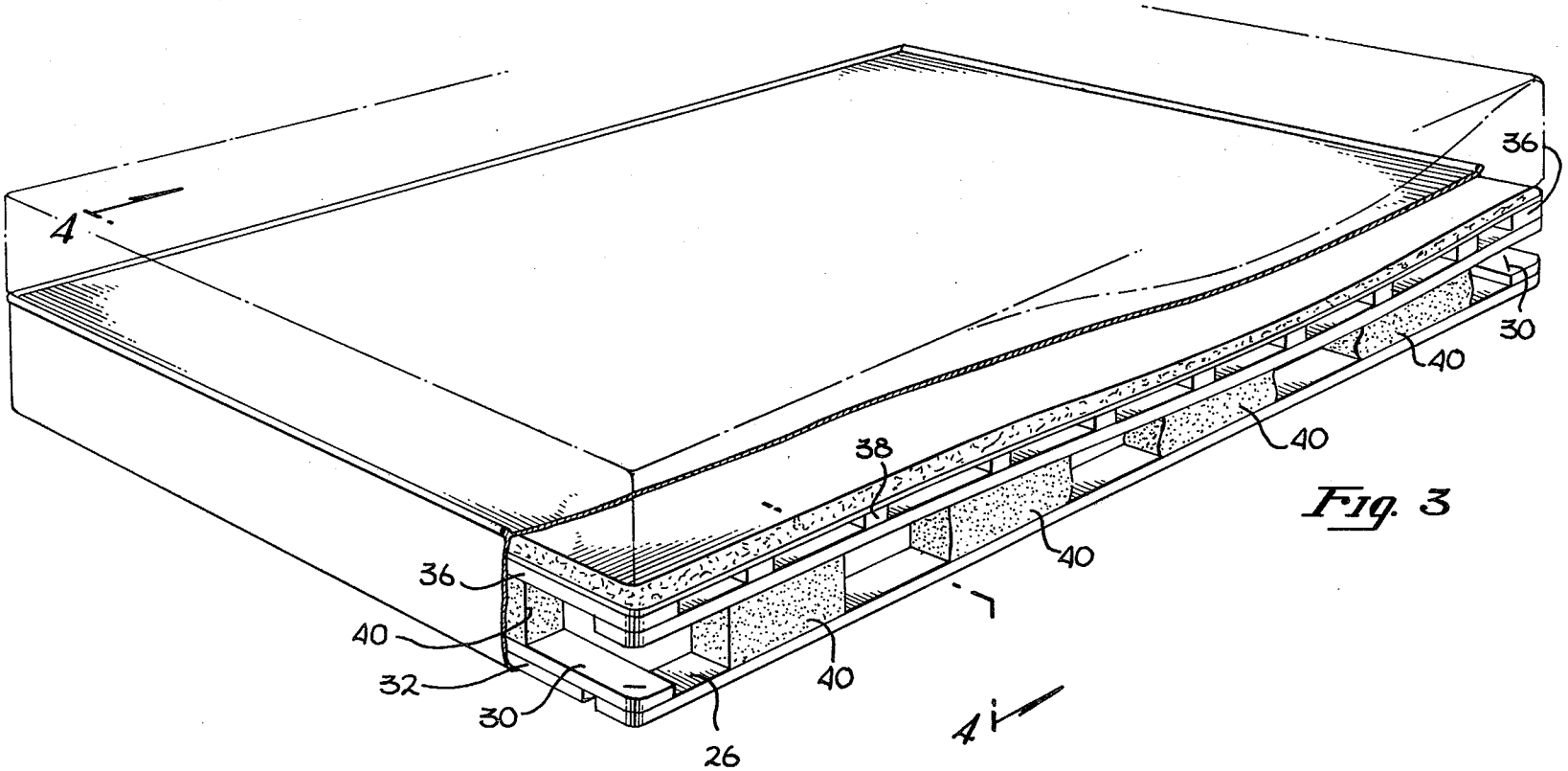
FIG. 3 is a schematic illustrating the deflection and flexibility of the assembly of FIG. 2.

Bonded between the upper and lower frame assemblies are a plurality of resilient non-metalic blocks 40 to provide predetermined compliance between these two assemblies. In the preferred embodiment, blocks comprising a urethane foam product have been utilized, with both prime material and rebond being suitable for the purpose. In that regard, blocks of flexible urethane foam having expanded polystyrene beads dispersed throughout the foam are also suitable. In the preferred embodiment, each block is approximately three inches by four inches by twelve inches long, with four blocks being disposed along each side and down the center, and two blocks being disposed at each end, giving a total of sixteen blocks. Obviously any lesser or greater number of blocks could be used, though they should be relatively evenly distributed, particularly around the edges of the assembly, with a solid peripheral boundary of foam or other resilient material also being suitable, provided it is properly proportioned and/or of material of appropriate flexibility to provide the desired result. In that regard, best performance of the mattress foundation is achieved if the total support area is chosen in relation to the flexibility of the foam so that little foam compression occurs when the anticipated load is reasonably well distributed over the upper frame assembly, but significant compression occurs when the anticipated loads are more concentrated so as to be distributed over only a small portion of the total support, as occurs when a person sits on the edge of a bed. In fact, as schematically illustrated in FIG. 3, the preferred size and compliance of the blocks and the flexibility of the upper frame assembly are such that when a person sits on the edge of a bed, as illustrated by the load being applied to the assembly of FIG. 3, deformation of the foam blocks tends to be concentrated in the approximate area of the load, with the more remote blocks having little or no significant deformation. As such, excellent side-wise stability is maintained without any special or extra provision to maintain such stability. In addition, the noise of metal to metal and wood to metal rubbing characteristic of box springs is non-existent in the assembly.

Figure 4:
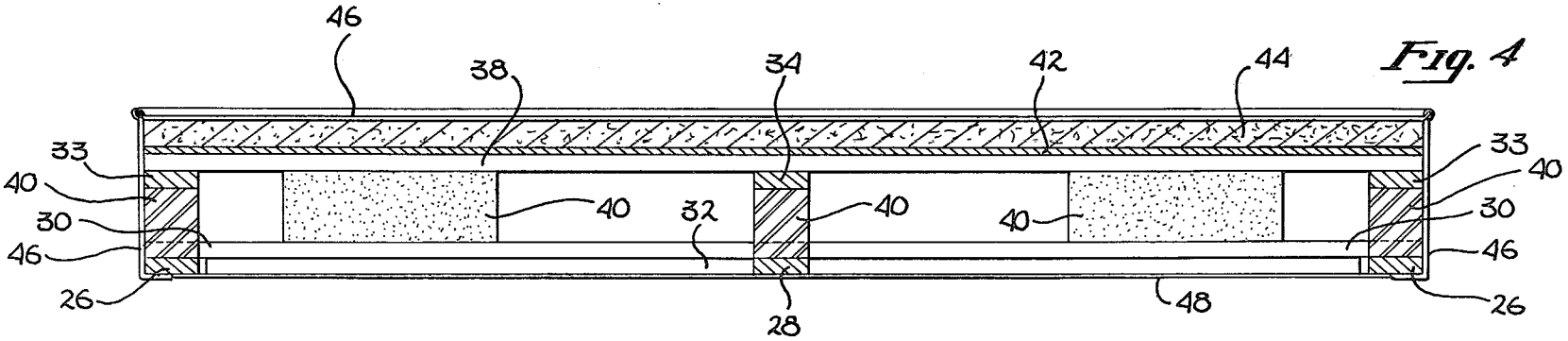
FIG. 4 is a cross section of a typical completed mattress foundation utilizing the assembly of FIGS. 2 and 3.

Now referring to FIG. 4, a cross section of a typical completed mattress foundation in accordance with the preferred embodiment of the present invention may be seen. This cross section is a longitudinal cross section taken between slots and through three of the support blocks. A typical completed mattress foundation will include not only the assembly of FIG. 2 but in addition will be provided with some suitable pad and mattress foundation cover. In the embodiment of FIG. 4, a layer of cardboard or other support materials 42 is first disposed over the slats 38 and end members 36 and then covered with flexible urethane foam pads 44, preferably on the order of one and one-half inches thick. Finally, a conventional mattress foundation cover 46 is put over the entire assembly, with the bottom of the mattress foundation being covered by a very light woven or non-woven cloth to provide for the required breathing of the assembly when in use.

There has been described herein a new and unique mattress foundation which may be used as a replacement for conventional box spring foundations and which is particularly useful with foam mattresses to simulate the feel of box springs under certain conditions. The specific embodiment disclosed is of a particular configuration particularly suited for queen size beds, with the upper and lower frame assemblies being characterized not only by peripheral members but also by central members between which additional foam support blocks or members are provided to provide the additional support for this size. It is to be understood, however, that various changes in the general configuration may be made within the concept of the present invention, such as, by way of a simple example, the elimination of the central members and the narrowing of the assembly to provide a mattress foundation suitable for a single bed. Also, obviously other materials may be used for the frame assemblies, though wood is particularly desirable because of its relatively low cost, low weight, ease of fabrication, etc. Similarly, while flexible urethane foam products are ideal for the non-metallic resilient members, as they are relatively low cost, have the desired support characteristics, provide good side-wise stability and may be readily cemented to wood with any of a number of commercially available adhesives, such as by way of example contact cements, various types of foam cements and hot melt adhesives, other non-metallic resilient materials may also be used, such as by way of example, rubber and latex foam, butadiene, A.B.S. and butadiene styrene, to name but a few other examples. In general, foams are ideal for such use as they provide relatively large areas of support, making them relatively easy to cement to the frame assembly without any special reinforcement at the support points, and also providing good side-wise stability between the two frame assemblies because of their substantial width and length relative to the thickness (deflection direction) of the blocks. In that regard, the proportions and dimensions of the foam members may be varied in accordance with the flexibility of the foam to provide the desired result.

Thus, while a specific embodiment of the present invention has been disclosed and described in detail herein, it will be understood by those skilled in the art that various changes in form and detail may be made therein without departing from the spirit and scope of the invention.

We claim:

1. A mattress foundation comprising:

a lower wooden frame assembly having peripheral lower frame members defining upward facing surfaces;

a partially flexible upper wooden frame assembly having peripheral upper frame members overlying said peripheral lower frame members so as to define oppositely disposed upper and lower frame surfaces, a plurality of slats extending between and fastened to the sides of said upper frame assembly and distributed over its length to define an open support surface, flexible foam members distributed about the periphery of said frame assemblies and cemented to said oppositely disposed upper and lower frame surfaces, a foam pad disposed over said upper frame assembly and slats, and a fabric cover over said mattress foundation.

2. The mattress foundation of claim 1 further comprised of additional flexible urethane foam members and upper and lower central frame members, said upper and lower central frame members being coupled centrally between the ends of said upper and lower wooden frame assemblies, respectively, and having oppositely disposed surfaces, said additional flexible urethane foam members being cemented to said oppositely disposed surfaces of said upper and lower central frame members.

3. The mattress foundation of claim 1 wherein said flexible foam members are flexible urethane members.

4. The mattress foundation of claim 3 wherein said flexible urethane foam members have expanded plastic beads dispersed throughout the foam.

5. The mattress foundation of claim 4 wherein said expanded plastic beads are expanded polystyrene beads.

* * * * *